United States Patent [19]

Scheler

[11] Patent Number: 4,848,682

[45] Date of Patent: Jul. 18, 1989

[54] DOUBLE BLADED ROCK CRUSHER

[76] Inventor: Morris Scheler, Star Rte., Box 305, Magnet, Ind. 47555

[21] Appl. No.: 200,360

[22] Filed: May 31, 1988

[51] Int. Cl.[4] ..... B02C 13/28

[52] U.S. Cl. ..... 241/190; 241/191; 241/285 B; 241/286

[58] Field of Search ..... 241/189 R, 190, 189 A, 241/191, 285 B, 188 R, 188 A, 243, 286

[56] References Cited

U.S. PATENT DOCUMENTS

| | | | |
|---|---|---|---|
| 1,337,127 | 4/1920 | Friedrich | 241/190 |
| 3,224,688 | 12/1965 | Beiter | 241/189 R X |
| 4,651,934 | 3/1987 | Bender et al. | 241/189 A X |

FOREIGN PATENT DOCUMENTS

| | | | |
|---|---|---|---|
| 479487 | 11/1975 | U.S.S.R. | 241/189 R |
| 774366 | 5/1957 | United Kingdom | 241/190 |

*Primary Examiner*—Mark Rosenbaum
*Attorney, Agent, or Firm*—Scott R. Cox

[57] ABSTRACT

This invention discloses a rock, stone or other solid material crushing device. It consists of a crushing chamber, a rotator shaft running through the chamber, an outer cutting blade secured to the chamber, a set of outer cutting bars which are secured to a disk which is secured to and rotates with the rotator shaft and acts as a mechanism for breaking apart the solid material to be crushed. Within the rotational arc of the outer cutting bars is a pair of inner cutting blades. Inside of the inner cutting blades and attached to the rotator shaft disk is a second set of cutting bars, i.e. the inner cutting bars. The inner cutting blades are secured to the outside of the crushing chamber and intrude into the crushing chamber such that the outer cutting bars rotate outside of the pair of inner cutting blades and the inner cutting bars rotate inside the inner cutting blades. This crushing device provides three locations for the breaking apart of the solid material, a vast improvement over prior art devices which only provided one crushing or breaking mechanism within each crushing chamber.

10 Claims, 4 Drawing Sheets

DOUBLE BLADED ROCK CRUSHER

BACKGROUND OF THE INVENTION

1. Field of Invention

This invention relates to an apparatus for the crushing of solid materials such as rock or stone. In particular, this invention relates to rock and stone crushers which use two sets of cutting blades within the same crushing chamber for reducing large rocks or stones to usable sizes in one continuous operation.

2. Prior Art

Stone or rock mined from quarries is generally of a size which is unusable for common applications such as road building. These large pieces of rock or stone are usually broken down into usable sizes by rock crushers. The more useful sizes of stone are usually from about ½ inch to about 2 inches.

Many conventional rock crushers are available which will reduce rock or stone from large size rock to a usable size rock. For example, U.S. Pat. No. 3,784,117 discloses a rotary impact crusher comprised of impact bars secured within a rock crusher by wedge members. The impact bars fling the rocks or stones which are placed within the rock crusher against impact plates, said action resulting in the breaking of the stone or rock.

One of the deficiencies of conventional impact or rock crushing devices is their inability to take large size rocks and crush them to a consistently small size in a short period of time since conventional crushers contain only a single crushing mechanism within the crushing mill. As a partial answer to this deficiency, U.S. Pat. No. 4,046,325 discloses an apparatus for crushing rock, stone and like material which comprises a primary rotary impactor chamber and a secondary hammermill crushing chamber. In this device the first chamber contains a conventional rotary impactor wherein the rocks are impelled against triangular-shaped formations to break them up into smaller sized stones. The rocks reduced in size by the action of the rotary impactor are then transferred into a passageway. If the crushed material is of sufficiently small size, it exits through a discharge opening. However, if it is still too large, it will fall into a hammermill chamber where the rocks are further reduced in size by a hammermill crusher.

A somewhat similarly designed, two chamber apparatus for the comminuting of grain is disclosed in U.S. Pat. No. 3,595,290. The '290 patent discloses a double rotary, high velocity rotation mechanism.

While these double action rotary stone crushers or grain pulverizers are useful, a two chambered crushing device is necessarily inefficient and costly for the production of the proper size stone or grain. Further, neither of these devices discloses a two step crushing device contained in a single crushing chamber. A single chamber crushing device has substantial advantages over two chamber crushing devices since the crushing process would produce less dust and crush more rock, and the device would be less expensive to manufacture and easier to replace parts that have been damaged. In addition, since there would be two sets of cutting blades, the speed at which the machine would need to run to crush similar amounts of rock or stone could be reduced, thus reducing the wear and tear on the cutting bars and blades of the crushing device.

Therefore, it is an object of this invention to produce a solid material crushing device which is more efficient than prior art crushing devices.

It is another object of this invention to produce a stone crushing device which provides for more than one set of cutting blades within a single crushing chamber.

It is a still further object of this invention to produce a rock crusher which will produce more usable size rock and less dust than conventional rock crushers.

It is a still further object of this invention to produce a rock crusher with cutting blades which are easily replaceable and adjustable for producing rock or stone of a predetermined size.

It is a still further object of this invention to produce a two step rock crusher contained within a single crushing chamber.

These and other objects and features of the present invention will become apparent to those skilled in the art from a consideration of the following detailed description, drawings and claims. The description along with the accompanying drawings provides a selected example of construction of the device to illustrate the invention.

SUMMARY OF INVENTION

In accordance with the present invention, there is provided a solid material crushing device comprising:

a. a crushing chamber;

b. a rotator shaft running through and secured within the crushing chamber;

c. a rotator shaft mechanism secured to the rotator shaft wherein the rotator shaft mechanism rotates within the crushing chamber;

d. an adjustable outer cutting blade secured to the crushing chamber, a portion of which intrudes into the inner space of the crushing chamber;

e. a set of outer cutting bars secured to the rotator shaft mechanism which rotate within the crushing chamber wherein said outer cutting bars rotate in a circular arc inside of the outer cutting blade creating an opening between the outer cutting blade and each of the outer cutting bars as they rotate by the outer cutting blade;

f. a pair of inner cutting blades secured through the wall of the crushing chamber which intrude into the inner space of the crushing chamber within the circular arc of the outer cutting bars; and g. a set of inner cutting bars secured to the rotator shaft mechanism which rotate within the crushing chamber wherein said inner cutting bars rotate in a circular arc inside of the pair of inner cutting blades to provide an opening between the inner cutting blades and each of the inner cutting bars as they rotate by the inner cutting blades.

This rock or stone crushing device provides an inexpensive, readily adjustable device for the crushing of stone or other solid materials which produces less dust and more accurately crushed rock or stone than conventional rock crushing devices. Further, the outer cutting blade can be adjusted to produce rocks of various sizes. This device can be run at lower speeds and is cheaper to produce than conventional rock crushing devices. It is highly mobile and can be modified to produce materials of great size variance depending upon the needs of the particular job.

BRIEF DESCRIPTION OF THE DRAWINGS

The invention will now be described with reference to the accompanying drawings in which.

DETAILED DESCRIPTION OF THE PREFERRED EMBODIMENT

Figure 1:
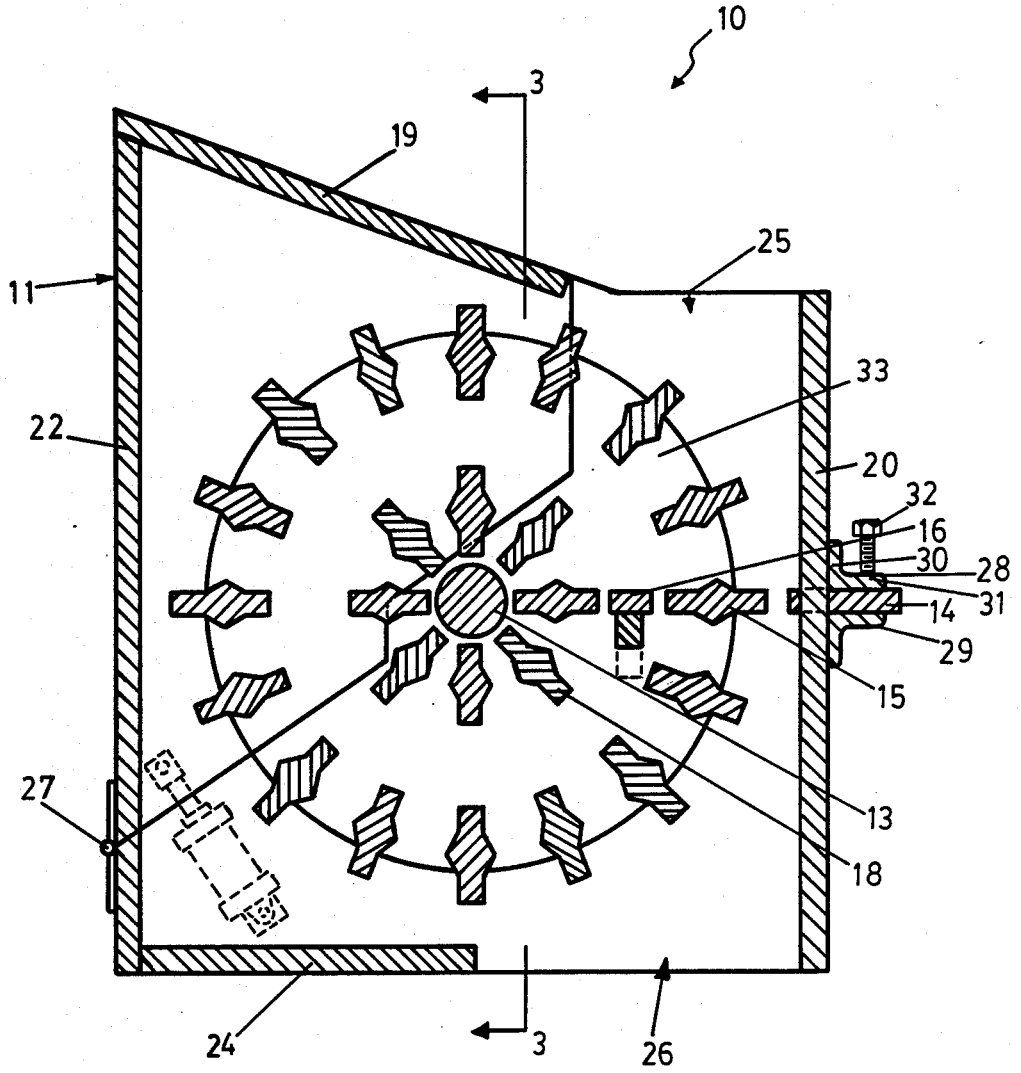
FIG. 1 is a side view of the Rock Crusher.

Although the invention is adaptable to a wide variety of uses, it is shown in the drawings for the purposes of illustration as embodied in a rock crushing device (10) consisting of a crushing chamber (11), a rotator shaft mechanism (12) containing a rotator shaft (13) for the rotation of the rotator shaft mechanism contained within the crushing chamber, a motor (not shown) for rotating the rotator shaft, an adjustable outer cutting blade (14) secured to the crushing chamber, a set of outer cutting bars (15) secured to the rotator shaft mechanism, a pair of inner cutting blades (16, 17) secured to the walls of the crushing chamber, and a set of inner cutting bars (18) secured to the rotator shaft mechanism. (See FIG. 1).

The crushing chamber can be of any size or shape sufficient to hold the other elements of the crushing device and is comprised of a top, (19) four walls (20, 21, 22, 23) and a bottom (24). The crushing chamber preferably contains an intake opening (25) in the top of the chamber to provide an easy input location for the rock, stone or other solid material to be crushed by the rock crusher. The crushing chamber should also have an exhaust opening (26) preferably located in the bottom of the crushing chamber to provide for the passage of the crushed stone and dust out of the crushing chamber. In a preferred embodiment the stones after leaving the crushing chamber pass through a set of screens (not shown) which separate the stones into various sizes for later use.

An exhaust vent duct mechanism (not shown) can also be secured to the crushing chamber to remove excess dust from the chamber. The exhaust vent duct mechanism can be any conventional exhaust vent mechanism well known in the industry such as is disclosed in U.S. Pat. No. 4,002,301.

The top of the crushing chamber can be and, in a preferred embodiment, is attached to the remainder of the crushing chamber by a hinge (27) of conventional construction. See FIG. 1. This hinge mechanism will allow the top of the chamber to be easily rotated away from the crushing chamber to permit the servicing of the rock crusher.

The crushing chamber can be manufactured from any conventional heavy duty material such as heavy duty steel of conventional strength and size ranging in thickness from about $\frac{1}{8}$ inch to about 1 inch.

Running through the crushing chamber and partially contained within the crushing chamber is the rotator shaft mechanism (12). An integral part of the rotator shaft (13) mechanism is the rotator shaft itself which runs through the crushing chamber and is of conventional construction. The rotator shaft is secured to a conventional motor (not shown) which rotates the rotator shaft. The rotator shaft mechanism will be described in more detail later.

Figure 2:
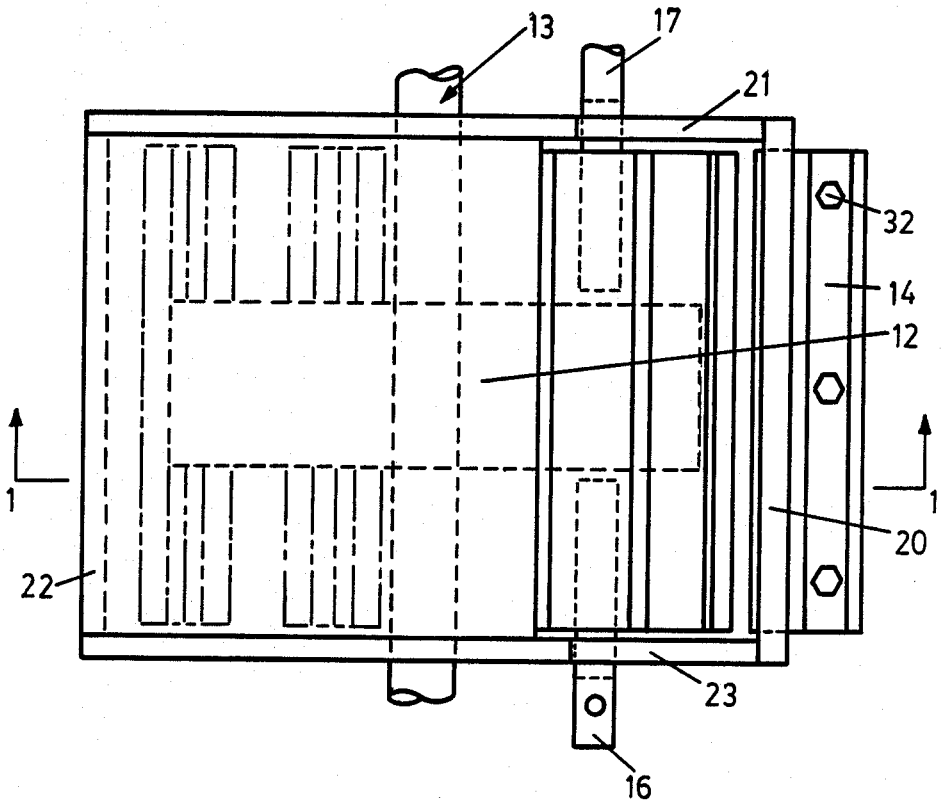
FIG. 2 is a top view of the Rock Crusher.

Secured to one of the walls of the crushing chamber, preferably the front wall, (20) is an outer cutting blade (14), preferably adjustable. The adjustable outer cutting blade is secured to the front of the crushing chamber and passes through the front wall of the chamber into the inner space contained within the crushing chamber. The adjustable outer cutting blade is approximately the same length as is the inner opening of the crushing chamber. Its depth can be of any conventional depth ranging from about 2 to about 5 inches. Its thickness is any conventional thickness for cutting blades used in rock crushers ranging from about $\frac{1}{4}$ of an inch to about 2 inches, depending upon the use and size of the crushing chamber. (See FIG. 2).

The adjustable outer cutting blade can be manufactured of conventional rock crushing material, such as hardened steel or other material conventionally used in the crushing of stone.

The adjustable outer cutting blade is held in place by a pair of L shaped brackets (28, 29) with the first arm (30) of the L secured to the outside of the front wall of the crushing chamber and the second arm (31) placed flat against the adjustable outer cutting blade. Running through the second arm of the L shaped bracket is a plurality of screws (32) or other type of securing devices for holding the adjustable outer cutting blade securely in place. By loosening these screws the adjustable cutting blade can be moved into the crushing chamber various distances to allow for various openings between the outer cutting blade and the outer cutting bars (which bars will be subsequently discussed).

An integral part of the rotator shaft mechanism is a rotator shaft disk (33) which is secured to the rotator shaft within the crushing chamber. The rotator shaft disk is secured to the rotator shaft by any conventional securing mechanism, such as welding, such that the disc will rotate in the same direction as the rotator shaft rotates. The disc can be comprised of any conventional material used in rock crushers such as heavy duty steel or other such material and can be solid or hollow in construction. In a preferred embodiment the disc is solid. The diameter of the rotator shaft disk is such that it can freely rotate within the crushing chamber, and when combined with the outer cutting bars, there is space between the outer cutting bars and the outer cutting blade. The thickness of the disc will vary depending upon the support necessary to hold securely the outer cutting bars and the inner cutting bars. Its thickness should not be so thick as to adversely affect the overall crushing mechanism. In a preferred embodiment the width of the disk is from about 1 to about 8 inches with its width varying depending upon the overall size of the crusher.

Although the rotator shaft mechanism disc can be located any place on the shaft, in a preferred embodiment, the disc is secured approximately in the middle of the crushing chamber with the outer cutting bars secured to the ends of the disc.

Figure 4:
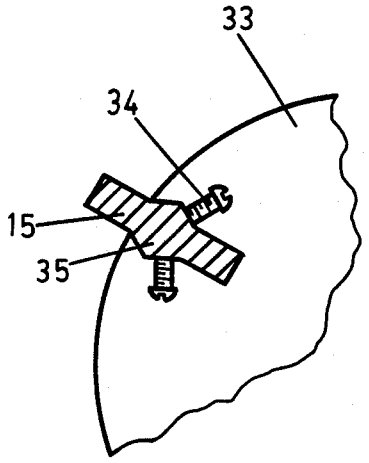
FIG. 4 shows the securing of an outer cutting bar within the Rock Crusher.

Secured to the rotator shaft disk is a set of outer cutting bars (15) which rotate around the rotator shaft within the crushing chamber as the disc rotates. The outer cutting bars are secured to the disc through openings in the disc and are held in place by locking screws (34) running through the disc which are tightened against each cutting bar. (See FIG. 4).

The outer cutting bars are made of conventional rock crushing material of similar material to that used in the outer cutting blade. Their dimensions are approximately the same as the outer cutting blade with the exception of containing a peaked portion. (35) (See FIG. 4). In a preferred embodiment the locking screws (34) are secured against the peaked portion (35) of each outer cutting blade to hold the blades securely in place. In a preferred embodiment the outer cutting bars are from about 2 to about 5 inches in depth and approximately the same length as the outer cutting blade. Any reasonable number of outer cutting bars can be used in the rock crusher, preferably from about 4 to about 24.

Attached to the sides of the crushing chamber and intruding into the inner space of the crushing chamber are at least one pair of inner cutting blades (16, 17). These inner cutting blades are secured to the sides of the crushing chamber by inner cutting blade L-shaped brackets (36) of similar construction to those that are used to secure the outer cutting disc. The inner cutting blades project into the crushing chamber up to but not touching the surface of the rotator shaft disk and are perpendicular to the disc. The inner cutting blades are located within the crushing chamber inside the rotational arc of the outer cutting blades such that as the outer cutting blades rotate, the inner cutting blades do not impede the rotation of the outer cutting bars. The distance between the inner cutting blades and the outer cutting bars is a predetermined distance which provides a secondary rock crushing action for the rock crusher. The blades are approximately the same thickness as are the outer cutting blade and the outer cutting bars and are constructed of the same type of material as is the outer cutting blade.

Figure 3:
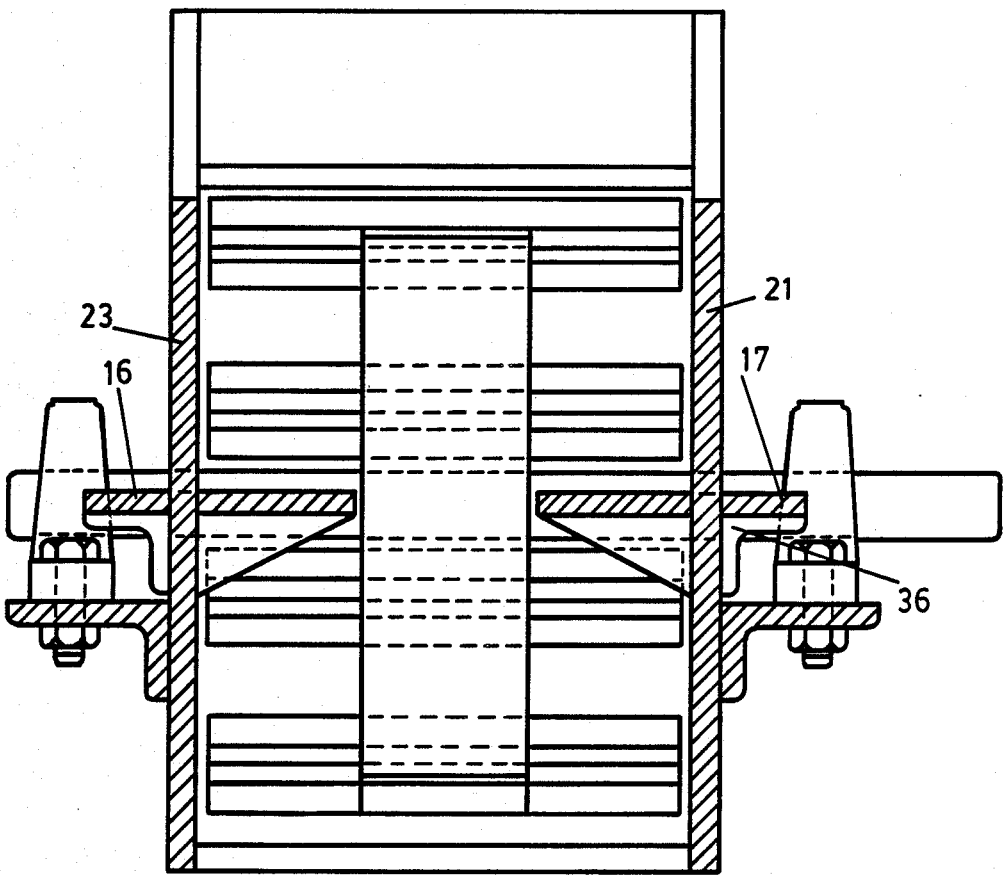
FIG. 3 is an end view of the Rock Crusher.

Inside the rotational arc of the outer cutting bars is a set of inner cutting bars (18). These inner cutting bars are secured to the rotator shaft mechanism disk and are of a similar size and shape as are the outer cutting bars. The inner cutting bars are secured to the rotator shaft mechanism disk by passing them through openings in the disk and securing them in that position by disc locking screws (not shown) of a similar size to the disc locking screws that secure the outer cutting bars. The disc locking screws project through the outside of the disc into the disc until they are secured against the surface of the inner cutting bars. (See FIG. 3).

The inner cutting bars (18) are constructed of the same type of material as are the outer cutting bars. As the inner cutting bars rotate, they maintain a circular arc inside the inner cutting blade (16, 17). As the inner cutting bars make their closest approach to the inner cutting blades, the distance between the inner cutting bars and the inner cutting blades is approximately the same distance as is between the inner cutting blades and the outer cutting bars. This provides a tertiary rock crushing mechanism within the rock crusher.

In operation the rotator shaft (13) of the rock crusher (10) is attached to a motor to provide sufficient speed of rotation of the shaft. The rock or other material to be crushed is placed within the crushing mechanism usually from a conveyor or other type of conveyance mechanism through the intake opening (25) in the rock crusher. As the material enters the rock crushing chamber, the outer cutting bars (15) grab or pull the material forward and downward as the rotator shaft mechanism rotates in a forward motion. The material to be crushed is forced between the outer cutting bars (15) and the outer cutting blade (14) and is broken into a size sufficient for use. The size of this material can be controlled by adjusting the size of the opening between the outer cutting blade and the outer cutting bars.

Although significant crushing will take place in the operation, some of the rock or other material to be crushed will fall between the outer cutting bars. This material will be forced forward either by the inside surface of the outer cutting bars (15) or by the inner cutting bars (18). The material will then be crushed or broken apart by the action of the inner cutting bars (18) or the outer cutting bars (15) acting on the material as it impacts against the inner cutting blades (16, 17). This material will then fall between the outer cutting bars to the exhaust opening (26) in the bottom of the rock crusher.

In a conventional usage this exhaust opening (26) is attached to an exhaust system which may include screens to separate out the various sizes of crushed material. It is also possible to attach to this rock crusher an exhaust system which will suck out excess dust or other powdery type residue from the rock crushing procedure. This exhaust can be attached to the exhaust opening (26) in the bottom (24) of the rock crusher or at any other convenient location within the crusher.

To provide for servicing of the rock crusher, the top surface of the crushing chamber is hinged to allow it to be opened to provide access to the rotator shaft mechanism and the cutting bars and blades located within the mechanism.

I claim:

1. A crushing device for the crushing of a solid material comprising:

a. a crushing chamber;

b. a rotator shaft running through and secured within the crushing chamber;

c. a rotator shaft mechanism attached to the rotator shaft wherein the rotator shaft mechanism rotates within the crushing chamber;

d. an outer cutting blade secured to the wall of the crushing chamber, a portion of which intrudes into the inner space of the crushing chamber;

e. a set of outer cutting bars secured to the rotator shaft mechanism which rotate within the crushing chamber wherein said outer cutting bars rotate in a circular arc inside of the outer cutting blade to create an opening between the outer cutting blade and each of the outer cutting bars as they rotate by the outer cutting blade;

f. a plurality of inner cutting blades secured through the wall of the crushing chamber, a portion of which intrude into the inner space of the crushing chamber inside the circular arc of the outer cutting bars; and g. a set of inner cutting bars secured to the rotator shaft mechanism to rotate within the crushing chamber wherein said inner cutting bars rotate in a circular arc inside the plurality of inner cutting blades to provide an opening between the inner cutting blades and each of the inner cutting bars as they rotate by the inner cutting blades whereby the solid material is crushed by the tangential interaction of the solid material with the outer cutting bars and the outer cutting blade, the outer cutting bars and the inner cutting blades, and the inner cutting bars and the inner cutting blades.

2. The device for crushing solid material of claim 1 wherein the device is a rock or stone crusher.

3. The device for crushing solid material of claim 1 wherein the outer cutting blade can be adjusted to create varying sizes of openings between the outer cutting blade and the outer cutting bars as they rotate by the outer cutting blade.

4. The device for crushing solid material of claim 1 wherein the crushing chamber is comprised of a top, four walls and a bottom, wherein the top contains an opening for the introduction of the solid material to be crushed and the bottom contains an opening through which the crushed material can exit the crushing chamber.

5. The device for crushing solid material of claim 4 wherein the top of the crushing chamber is connected to one of the sides of the crushing chamber by a hinge to allow the top to rotate away from the crushing chamber.

6. The device for crushing solid material of claim 1 wherein the rotator shaft mechanism is a circular shaped disk secured to the rotator shaft wherein the disk has a thickness from about 1 to about 8 inches.

7. The device for crushing solid material of claim 1 wherein the outer cutting bars are secured to the rotator shaft mechanism by means of locking screws which project through a portion of the disc and are tightened against the outer cutting bars to secure them in place.

8. The device for crushing solid material of claim 1 wherein the outer cutting blade is secured to the crushing chamber by a pair of L-shaped brackets with the first arm of each L-shaped bracket secured to the outer surface of the crushing chamber, the other arm of the L-shaped bracket placed against the outer cutting blade, and running through each of the second arms of the L-shaped brackets is a securing means for securing the outer cutting blade to the crushing chamber.

9. The device for crushing solid material of claim 8 wherein the securing device is a screw running through the second leg of the L-shaped brackets.

10. The device for crushing solid material of claim 1 wherein the opening between the outer cutting blade and the outer cutting bars can be adjusted between about $\frac{1}{4}$ inch and about 2 inches.

* * * * *